US005106214A

United States Patent [19]

Meisner

[11] Patent Number: 5,106,214

[45] Date of Patent: Apr. 21, 1992

[54] TYPE DISC FOR TYPEWRITERS OR THE LIKE

[75] Inventor: Olaf E. Meisner, Berlin, Fed. Rep. of Germany

[73] Assignees: Alfred Ransmayer; Albert Rodrian, both of Berlin, Fed. Rep. of Germany

[21] Appl. No.: 633,046

[22] Filed: Dec. 21, 1990

[30] Foreign Application Priority Data

Jan. 12, 1990 [DE] Fed. Rep. of Germany ..... 4001080

[51] Int. Cl.[5] ..... B41J 1/30

[52] U.S. Cl. ..... 400/144.2; 400/175

[58] Field of Search ..... 400/144, 144.1, 144.2, 400/144.3, 144.4, 175; 403/326, 332, 375

[56] References Cited

U.S. PATENT DOCUMENTS

| | | | |
|---|---|---|---|
| 3,878,929 | 4/1975 | Orlens | 400/175 |
| 3,986,593 | 10/1976 | Orlens | 400/144.2 |
| 4,465,387 | 8/1984 | Seitz | 400/175 |
| 4,496,254 | 1/1985 | Lau | 400/175 |
| 4,542,999 | 9/1985 | Bauer | 400/175 |
| 4,575,266 | 3/1986 | Moulin | 400/144.2 |
| 4,586,836 | 5/1986 | Moulin | 400/144.2 |
| 4,591,282 | 5/1986 | Bradley | 400/144.2 |
| 4,609,296 | 9/1986 | Bauer | 400/175 |

FOREIGN PATENT DOCUMENTS

| | | | |
|---|---|---|---|
| 3140177 | 4/1983 | Fed. Rep. of Germany . | |
| 3404590 | 8/1984 | Fed. Rep. of Germany . | |
| 3442776 | 6/1985 | Fed. Rep. of Germany . | |
| 3427761 | 11/1985 | Fed. Rep. of Germany . | |
| 3637437 | 5/1987 | Fed. Rep. of Germany . | |
| 1260252 | 9/1986 | U.S.S.R. | 400/144.2 |

OTHER PUBLICATIONS

Xerox Disclosure Journal, vol. 2, No. 4, Jul./Aug. 1977, "Retainer for Daisy Print Wheel".

*Primary Examiner*—Edgar S. Burr
*Assistant Examiner*—Eric P. Raciti
*Attorney, Agent, or Firm*—Mark P. Stone

[57] ABSTRACT

In a type disc for typewriters or the like, for locking the hub (1) of the type disc on a drive shaft there is a plurality of catch noses (7) arranged at the ends of cantilever arms (8, 11), of which the rear sides (9), as seen in the axial direction of the type disc, are at a distance from the inner wall (10) of a central hole (2) for receiving the drive shaft. The gaps which the maintained distance brings about allow an economical production of the type disc.

17 Claims, 2 Drawing Sheets

TYPE DISC FOR TYPEWRITERS OR THE LIKE

BACKGROUND OF THE INVENTION

The invention relates to a type disc for typewriters or the like, with a hub made of springy plastic and with springy spokes directed outwards from the hub in a radiating manner and designed as type carriers, in which type disc the hub is equipped with a central hole for a typewriter drive shaft serving for introducing rotational movements into the type disc and possesses resilient webs projecting beyond its side facing the free end of the drive shaft and having catch noses, or lugs, which can engage into an annular groove of the drive shaft, the rear sides of the webs, as seen in the axial direction of the type disc, being at a distance from the inner wall of the hole for receiving the drive shaft.

German Offenlegungsschrift 3,637,437 makes known a type disc of the foregoing type, which uses catch elements designed as resilient webs and having bead-like catch noses which engage into an annular groove of a drive shaft. The pliability of the webs as it were clamped at both ends is strictly limited, that is to say, put in the simplest terms, they cannot experience sufficient deformation in the radial direction. However, a sufficient deformability is not only required for the sake of easy mounting and dismounting, but is also necessary insofar as unavoidable production tolerances can be compensated in this way.

Also known from U.S. Pat. No. 3,986,593 is a type disc, in which the catch elements are formed by two pincer-like projections at the hub which have such a complicated form that they can be produced, if at all, by injection moulding and then only at a considerable tool outlay.

SUMMARY OF THE INVENTION

The object on which the invention is based is to provide a type disc of the kind under consideration, which can be produced with simple injection moulds and which, despite low production costs, guarantees a secure fit on the drive shaft, whilst at the same time affording the possibility of easy mounting and dismounting. According to the invention, in the case of a relevant type disc, this object is achieved in that the catch noses are arranged at the free ends of the webs designed as cantilever arms.

The type disc according to the invention affords the advantage of low production costs and a high flexibility of the cantilever arms in the radial direction, whilst ensuring a high rigidity in the axial direction.

BRIEF DESCRIPTION OF THE DRAWINGS

Further details and features of the invention emerge from the subclaims and from the following description of two embodiments shown in the drawing which illustrates the essence of the invention. In the drawing:

DESCRIPTION OF THE BEST MODES FOR CARRYING OUT THE INVENTION

Figure 1:
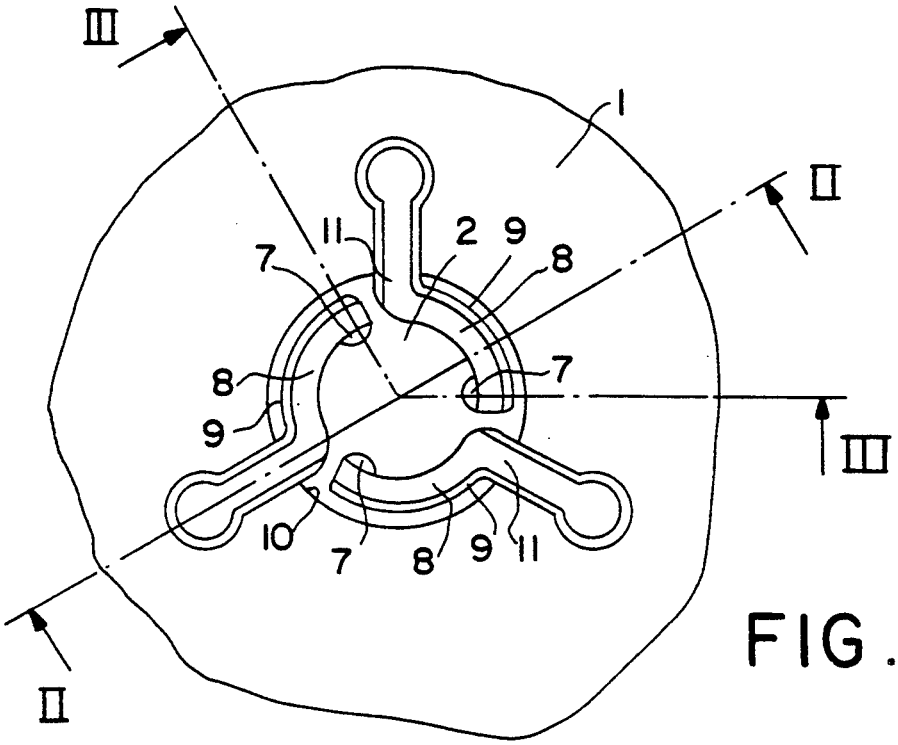
FIG. 1 shows a top view of the hub body of a first type disc.
Figure 2:
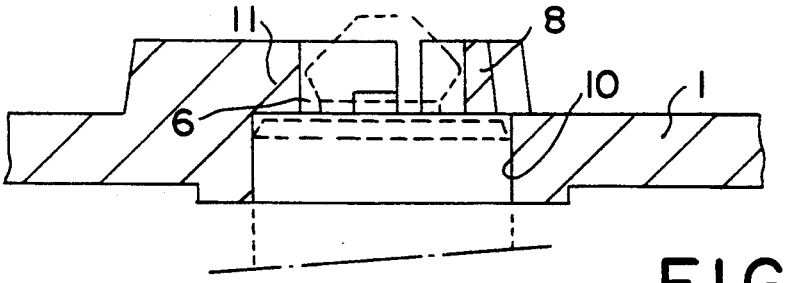
FIG. 2 shows a section along the line II—II in FIG. 1.
Figure 3:
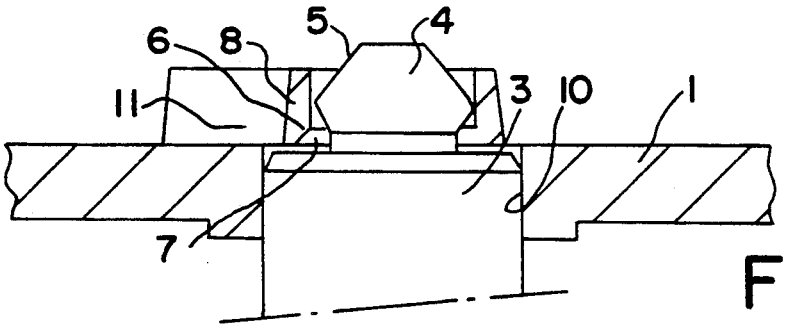
FIG. 3 shows a section along the line III—III in FIG. 1.

In FIGS. 1 to 3, 1 denotes the hub of a type disc, from which springy spokes (not shown) with type characters arranged at the free ends extend outwards in a known way. The hub 1 has a central hole 2, the diameter of which corresponds to the diameter of a drive shaft 3. On the end face of the drive shaft 3, the latter is equipped with a spreading head 4, of which the end facing away from the drive shaft 3 forms a spreading cone 5 and of which the end facing the drive shaft 3 forms, together with the end face of the drive shaft 3, a continuous groove 6 for receiving catch noses 7 serving for locking the type disc on the drive shaft 3. The catch noses 7 are arranged on the inner faces of the free ends of sickle-shaped cantilever-arm portions 8, of which the rear sides 9, as seen in the axial direction of the type disc (see FIG. 1), assume a distance from the inner wall 10 of the central hole. The ends of the cantilever-arm portions facing away from the catch noses 7 are connected to the hub 1 via short cantilever-arm portions 11 directed radially outwards, the cantilever-arm portions 11 forming integral parts of the hub 1. In order to give the cantilever-arm portions 8 sufficient rigidity in the axial direction, but sufficient flexibility in the radial direction, they have a substantially rectangular cross-section, that is to say, as seen in FIGS. 2 and 3, their height is greater than their width. Because the rear side 9 of the cantilever-arm portions 8 is offset radially inwards relative to the inner wall 10 of the hole 2, the cantilever-arm portions 8 can be produced by injection moulding by a simple means, that is to say there is particularly no need for any metal inserts ensuring the movability or pliability of the resilient cantilever-arm portions 8.

Figure 4:
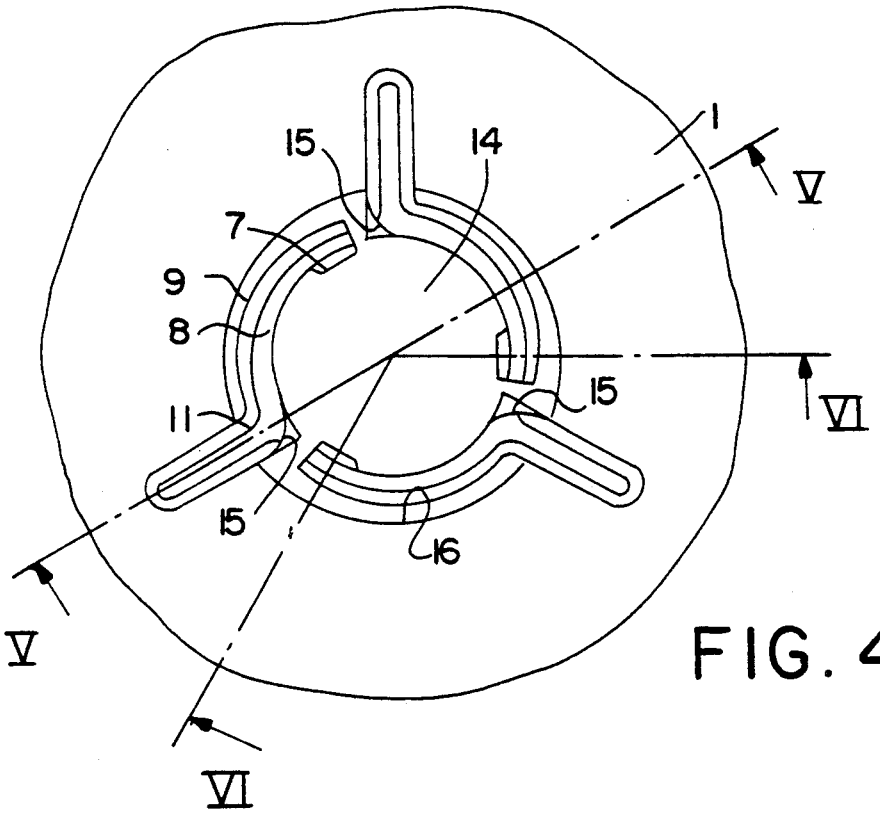
FIG. 4 shows a top view of the hub body of a second type disc.
Figure 5:
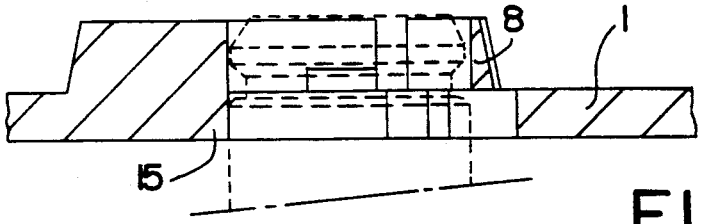
FIG. 5 shows a section along the line V—V in FIG. 4.
Figure 6:
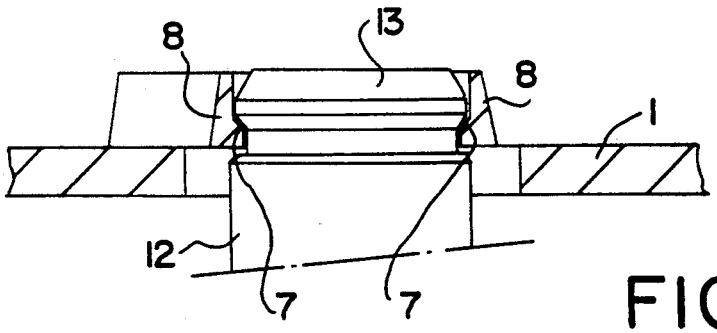
FIG. 6 shows a section along the line VI—VI in FIG. 4.

FIGS. 1 to 3 show the hub of a type disc intended for drive shafts 3, the spreading head of which has a clearly smaller diameter than the hole 2 of the type disc. In contrast, FIGS. 4 to 6 illustrate an embodiment intended for drive shafts 2, the spreading head 13 of which has a diameter only a little smaller than the diameter of the main part of the drive shaft 12. It is necessary, in this case, to equip the hub 1 of the type disc with a central hole 14, the diameter of which is larger than the diameter of the spreading head 13. In order nevertheless to guarantee a perfect fit of the type disc on the drive shaft 12, guide webs 15 for the drive shaft 12 are arranged in the region of the transitions between the sickle-shaped cantilever-arm portions 8 and the straight cantilever-arm portions 11. In the second embodiment too, gaps allowing a cost-effective production of the type disc are therefore obtained between the rear side 9 of the cantilever-arm portions 8 and the inner wall 16 of the central hole 14, as seen in the axial direction of the drive shaft 12 and type disc.

I claim:

1. A printwheel for typewriters or the like having a hub made of resiliently deformable synthetic material and defining a central hole having an inner wall for receiving a drive shaft for providing rotation of said printwheel; said hub carrying a plurality of flexible webs; said plurality of flexible webs including lugs for engaging and end of said drive shaft having an annular receiving groove defined therein; each of said webs having a rear portion being positioned at a distance from said inner wall of said central hole as seen in an axial direction of said printwheel;

characterized in that said webs are formed from cantilever arms having arcuate portions partially surrounding said drive shaft in an arch-wise manner when said drive shaft is received in said central hole; and that each of said arcuate portions has opposed ends, one of said ends being attachable to the hub and the other of said ends being provided with one of said lugs for engaging said drive shaft.

2. Printwheel according to claim 1, characterised in that the cantilever arms (8, 11) are arranged in a plane parallel to the hub (1).

3. Printwheel according to claim 2, including a guide element (15) for the drive shaft (12) arranged in the region of the end of each of the arcuate portions attachable to said hub.

4. Printwheel according to claim 2, having a gap between said end of said arcuate portion attachable to said hub and the inner wall of the central hole of the hub characterized in that each of said cantilever arms includes a straight connecting portion bridging said gap for connecting said arcuate portion to said hub.

5. Printwheel according to claim 2, characterized in that it has three cantilever arms (8, 11) distributed uniformly over the circumference of the hub (1).

6. Printwheel according to claim 2, characterized in that the cantilever arms have a substantially rectangular cross-section with shorter sides and longer sides and are arranged relative to the hub such that the shorter sides of said rectangular cross-sectional area are oriented parallel to the plane of the hub.

7. Printwheel according to claim 1, including a guide element (15) for the drive shaft (12) arranged in the region of the end of each of the arcuate portions attachable to said hub.

8. Printwheel according to claim 7, characterised in that it has three cantilever arms (8, 11) distributed uniformly over the circumference of the hub (1).

9. Printwheel according to claim 7, having a gap between said end of said arcuate portion attachable to said hub and the inner wall of the central hole of the hub characterized in that each of said cantilever arms includes a straight connecting portion bridging said gap for connecting said arcuate portion to said hub.

10. Printwheel according to claim 9, characterized in that the straight connecting portion of each of said cantilever arms extends radially outwardly relative to the central hole of the hub.

11. Printwheel according to claim 9, characterized in that the cantilever arms have a substantially rectangular cross-section and are arranged relative to the hub such that the shorter sides of said rectangular cross-sectional area are oriented parallel to the plane of the hub.

12. Printwheel according to claim 1, having a gap between said end of said arcuate portion attachable to said hub and the inner wall of the central hole of the hub characterized in that each of said cantilever arms includes a straight connecting portion bridging said gap for connecting said arcuate portion to said hub.

13. Printwheel according to claim 12, characterized in that the straight connecting portion of each of said cantilever arms extends radially outwardly relative to the central hole of the hub.

14. Printwheel according to claim 12, characterised in that it has three cantilever arms (8, 11) distributed uniformly over the circumference of the hub (1).

15. Printwheel according to claim 12, characterized in that the cantilever arms have a substantially rectangular cross-section with shorter sides and longer sides and are arranged relative to the hub such that the shorter sides of said rectangular cross-sectional area are oriented parallel to the plane of the hub.

16. Printwheel according to claim 1, characterised in that it has three cantilever arms (8, 11) distributed uniformly over the circumference of the hub (1).

17. Printwheel according to claim 1, characterized in that the cantilever arms have a substantially rectangular cross-section with shorter sides and longer sides and are arranged relative to the hub such that the shorter sides of said rectangular cross-sectional area are oriented parallel to the plane of the hub.

* * * * *

UNITED STATES PATENT AND TRADEMARK OFFICE

CERTIFICATE OF CORRECTION

PATENT NO. : 5,106,214

DATED : April 21, 1992

INVENTOR(S) : Olaf E. Meisner

It is certified that error appears in the above-identified patent and that said Letters Patent is hereby corrected as shown below:

Column 2, Line 66 (Claim 1, Line 7): Delete "and" and substitute - -an- -.

Column 3, Line 29 ( Claim 6, Line 3): Delete "and" (second occurrence) and substitute - -,said cantilever arms- -.

Column 4, Line 30 (Claim 15, Line 4): Delete "and" and substitute - -,said cantilever arms- -.

Column 4, Line 38 (Claim 17, Line 3): Delete "and" (second occurrence) and substitute -–, said cantilever arms- -.

Signed and Sealed this

Fifteenth Day of June, 1993

*Attest:*

Michael K. Kirk

MICHAEL K. KIRK

*Attesting Officer*

*Acting Commissioner of Patents and Trademarks*